US007308987B2

(12) United States Patent
Richardson et al.

(10) Patent No.: US 7,308,987 B2
(45) Date of Patent: Dec. 18, 2007

(54) MODULAR DISPLAY APPARATUS

(75) Inventors: Joseph Thomas Richardson, Irvine, CA (US); Gregory James Warren, Costa Mesa, CA (US); Thomas R. Lee, Mission Viejo, CA (US)

(73) Assignee: Behr Process Corporation, Santa Ana, CA (US)

( * ) Notice: Subject to any disclaimer, the term of this patent is extended or adjusted under 35 U.S.C. 154(b) by 396 days.

(21) Appl. No.: 11/022,392

(22) Filed: Dec. 22, 2004

(65) Prior Publication Data

US 2006/0131253 A1 Jun. 22, 2006

(51) Int. Cl.
*A47B 43/00* (2006.01)

(52) U.S. Cl. ..... 211/189; 211/126.2

(58) Field of Classification Search ..... 211/189, 211/13.1, 50, 85.26, 126.4, 45, 126.2, 126.12, 211/134

See application file for complete search history.

(56) References Cited

U.S. PATENT DOCUMENTS

| | | | | | |
|---|---|---|---|---|---|
| D153,961 | S | * | 5/1949 | Malkin | D6/407 |
| 4,003,470 | A | * | 1/1977 | Lagorio et al. | 211/50 |
| 4,102,072 | A | * | 7/1978 | Buschman | 40/124.2 |
| 6,145,671 | A | * | 11/2000 | Riga et al. | 211/13.1 |
| 6,331,858 | B2 | | 12/2001 | Fisher | |
| 6,336,564 | B1 | * | 1/2002 | Garnier | 211/162 |
| 6,563,510 | B1 | | 5/2003 | Rice et al. | |
| 6,632,093 | B1 | | 10/2003 | Rice et al. | |
| D481,882 | S | | 11/2003 | Richardson et al. | |
| D481,883 | S | | 11/2003 | Richardson et al. | |
| D481,884 | S | | 11/2003 | Richardson et al. | |
| D482,207 | S | | 11/2003 | Richardson et al. | |
| D488,001 | S | | 4/2004 | Richardson et al. | |
| D488,318 | S | | 4/2004 | Richardson et al. | |
| D488,633 | S | | 4/2004 | Richardson et al. | |
| D493,045 | S | | 7/2004 | Richardson et al. | |
| D497,269 | S | | 10/2004 | Richardson et al. | |
| D497,495 | S | | 10/2004 | Richardson et al. | |
| 7,150,365 | B2 | * | 12/2006 | Hardy et al. | 211/189 |
| 7,175,034 | B2 | * | 2/2007 | Nook et al. | 211/189 |
| 7,204,376 | B2 | * | 4/2007 | Richardson et al. | 211/189 |
| 2005/0100210 | A1 | | 5/2005 | Rice et al. | |

* cited by examiner

*Primary Examiner*—Jennifer E. Novosad
(74) *Attorney, Agent, or Firm*—Greenberg Traurig, LLP; Franklin D. Ubell

(57) ABSTRACT

A plurality of separate display modules are interchangeably installed on a shelf of a cooperating cabinet structure and arranged to provide convexly curved display panels mounting selected arrangements of illuminated sample chips, an interactive video display, and brochure receptacles. The structure is provided with an integral sprinkler water distribution system and may include a two-part sample chip mounting mechanism which facilitates changing out of sample chips.

15 Claims, 18 Drawing Sheets

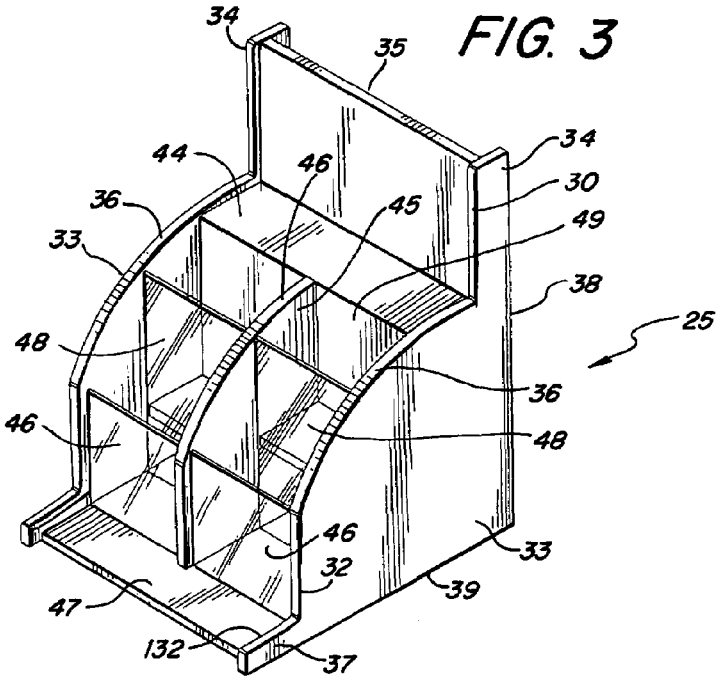
FIG. 3
FIG. 4
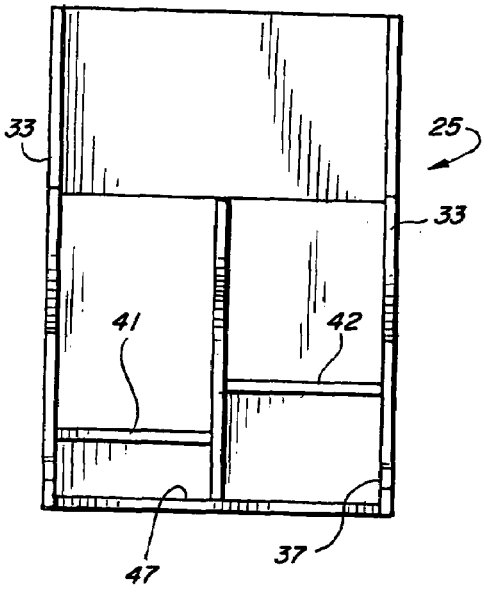
FIG. 5
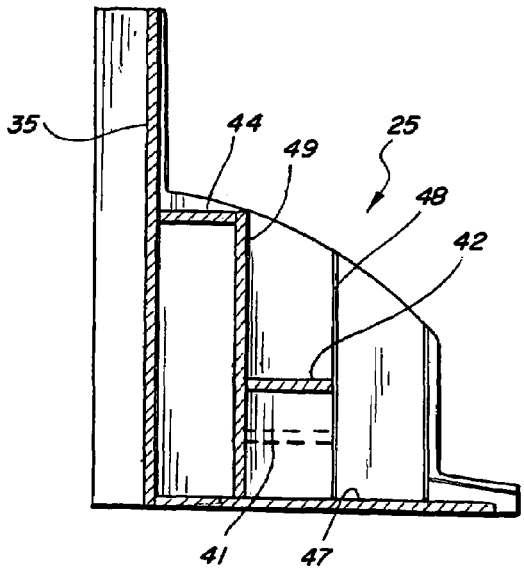

MODULAR DISPLAY APPARATUS

BACKGROUND

The present invention relates generally to a modular display apparatus and more particularly to a modular display apparatus having a number of improved static display features, as well as interactive instructional capabilities. In an illustrative embodiment, these features are directed to the selection and application of wood treatment products.

In the past, wood treatment products such as paints, stains, water proofers etc. have customarily been made available for purchase at various hardware, paint supply, and home supply stores. Selection of an appropriate product by the consumer has entailed reading product labels and brochures, examining various samples, and chatting with store personnel in a decentralized and often ad hoc or haphazard manner. Learning how to properly apply such products typically involves discussion with store personnel, reading often terse product labeling and trial and error.

SUMMARY

The following is a summary of various aspects and advantages realizable according to various embodiments of a modular display apparatus according to the present invention. It is provided as an introduction to assist those skilled in the art to more rapidly assimilate the detailed discussion of the invention that ensues and does not and is not intended in any way to limit the scope of the claims that are appended hereto.

With this in mind, according to one aspect of the invention, there is provided a modular display comprising a number of interchangeable modules installable adjacent one another on a shelf. The modules may be designed to conveniently present samples and brochure information. According to another inventive aspect, one of the modules may comprise an interactive video unit providing instruction as to product selection and/or application. One or more of the modules may further provide concavely curved receptacles or grooves for receiving a flat display panel and imparting a concave contour thereto. Such a panel may carry sample chips, attached, for example, by a two piece chip holder which facilitates removal or changing out of sample chips.

According to another aspect, a mechanism is provided for removably retaining the modules in place on the shelf. One embodiment of such a mechanism comprises a panel slideable into and out of position between the shelf and the modules. A front molding piece is attached to the front panel and comes into abutment with the modules to retain them in place.

A specially designed lighting fixture may further be provided to uniformly and attractively illuminate the display. The modular structure may further be provided with a sprinkler irrigation feature comprising a water flow-through system for channeling and distributing water discharged by fire sprinkler systems.

Various of the inventive aspects just discussed may be combined to provide a product selection center where a customer may conveniently and centrally access information concerning the selection and application of wood treatment products.

BRIEF DESCRIPTION OF THE DRAWINGS

FIG. 3 is a perspective view of a first of the display modules of FIG. 2;

FIG. 4 is a front view of the display module of FIG. 3;

FIG. 5 is a side view of the display module of FIG. 3;

DETAILED DESCRIPTION OF THE ILLUSTRATED EMBODIMENTS

Figure 1:
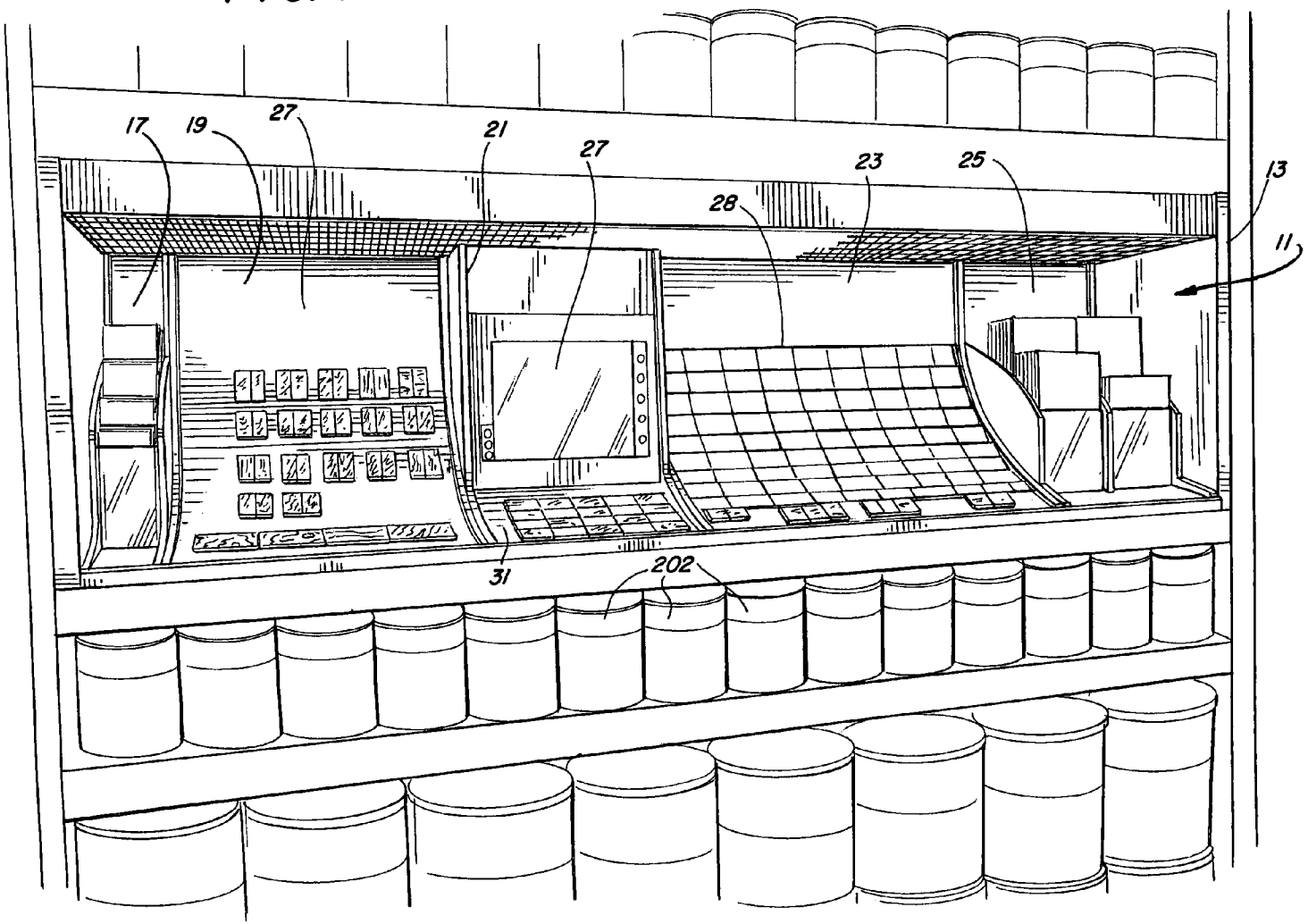
FIG. 1 is a perspective view of an illustrative embodiment of a display apparatus according to the invention.

A display apparatus 11 according to an illustrative embodiment is shown FIG. 1. The apparatus 11 includes a cabinet 13 which mounts 5 display modules, 17, 19, 21, 23, 25. In the illustrated embodiment, the modules 17,19, 21, 23, 25 separately mount into the cabinet 11 and therefore are subject to being reordered in any desired sequence.

The first and fifth display modules 17, 25 comprise brochure display modules. The first display module 17 presents brochures of a first size, while the fifth display module displays brochures of a second size. The size, of course, could be the same or different, as desired.

The second and fourth display modules 19, 23, mount respective concave display panels 27, 28. The first display panel of 27 may provide a display of a plurality of wood chips to each of which has been applied a different water proofing coating. The second display panel 28 may present a display of a plurality of wood chips each stained with a different wood stain, which may be, for example, either a solid and/or semi-transparent stain.

The third display module 21 includes an interactive instructive video display 29, which may comprise a DVD/DVI (143, FIG. 26) player. The module 21 further mounts a display panel 31. The display panel 31 preferably mounts a plurality of adjacently disposed wood chips. Each of the chips comprises a different species of wood to which the same wood stain product has been applied. In this manner, a potential customer may appreciate the difference in overall appearance contributed by the underlying wood species.

A recessed fluorescent lighting fixture 27 is disposed above the display modules 17, 19, 21, 23, 25. As will be explained in more detail below, the recessed lighting fixture 27 is specially designed to provide optimum and uniform illumination of the samples displayed by the display panels 27, 28.

Figure 2:
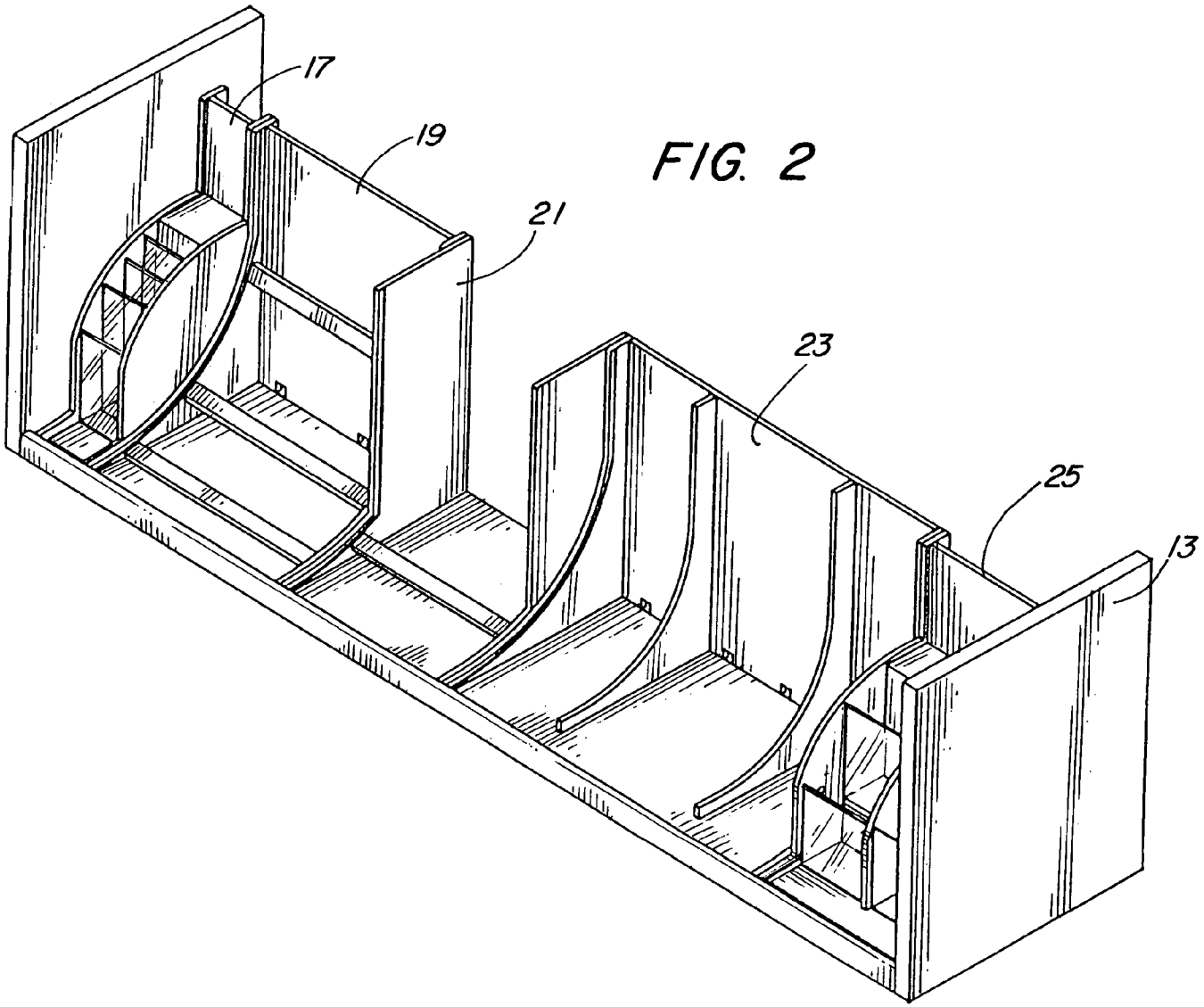
FIG. 2 is a perspective view illustrating a plurality of display modules employed in the display apparatus of FIG. 1.

FIG. 2 illustrates the display apparatus 11 and the modules 17, 19, 21, 23, 25 with various graphic display components removed. Each of these components 11, 17, 19, 21, 23, 25 of FIG. 2 will be now described in more detail.

FIGS. 3 thru 5 illustrate the construction of the large brochure module 25. This module 25 includes first and second side panels, 33, each of which has a bottom edge 39 and back edge 38, which meet at right angles to one another. The front edge of each panel 33 is defined by a first vertical linear section 30, which meets with a convexly curved section 36, which then leads to a second vertical depending section 32. The vertical section 32 forms into a surface whose top edge 132 is disposed at a slightly acute angle to the horizontal. Thus, a vertical leg 34 and a horizontal foot 37 are defined on each of the side panels 33. The side panels 33 are linked to one another by a back panel 35, a floor or base panel 47, and by an upper horizontal panel 44. The module 25 further includes a central panel 45 having a convex outer edge 46, which lies in parallel with the respective convex edges 36 of the side panels 33. A hole 26 is formed in the floor panel 47 through which a fastening device such as a screw may be inserted to fasten or attach the module 25 to an underlying shelf or other structure.

Respective deck panels 41, 42 are disposed between the first side panel 33 and the central panel 45 and between the central panel 45 and the second side panel 33, respectively. Clear vertical face panels 46, 48 are further mounted in slots in the respective side and central panels 33, 45. The face panels 46, 48 may comprise, for example, plexi-glass preferably anchored in place by a suitable adhesive. The panels 33, 35, 47, 45 of the module 25 are preferably made of suitable wood or wood substitute materials fastened together according to conventional means well-known to those skilled in the woodworking arts.

Figure 7:
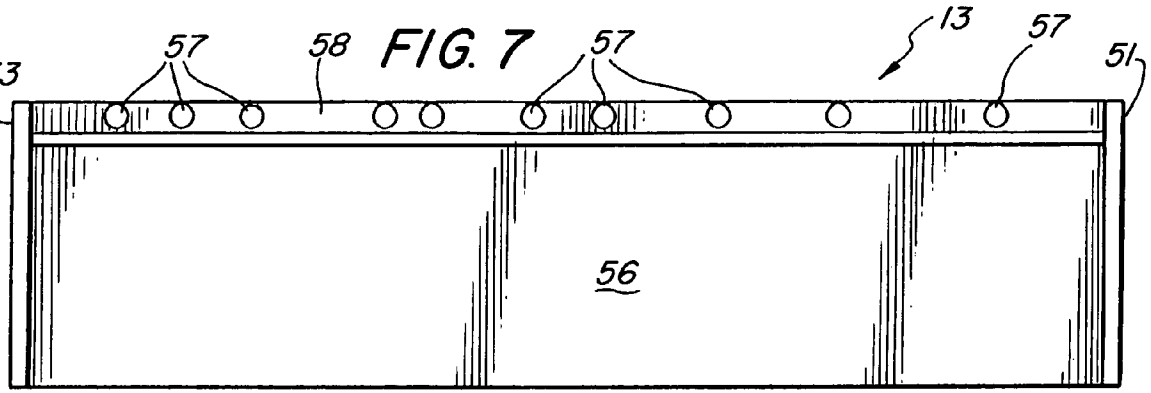
FIG. 7 is a top view of the cabinet of FIG. 6.
Figure 6:
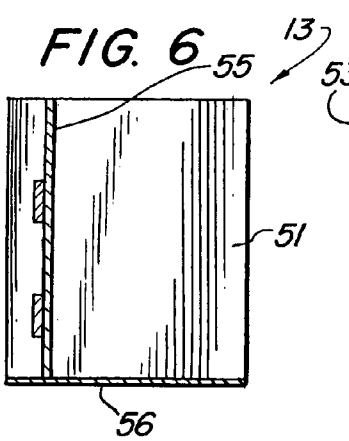
FIG. 6 is a side view of a cabinet component in which display modules employed in the apparatus of FIG. 1 may be installed.

FIGS. 6 and 7 further illustrate the cabinet 13, which mounts the five modules 17, 19, 21, 23, 25. As shown, the cabinet 13 preferably includes identical rectangular vertically disposed end panels 51, 53, between which are mounted a horizontal rectangular base "shelf" 56 and a vertical rectangular back panel 55. The back panel 55 is inset from the back edge 58 of the base 56. Holes 57 are bored through base portion or shelf 56 behind the back panel 55 to facilitate water flow according to a fire prevention irrigation feature described in more detail hereafter.

Figure 9:
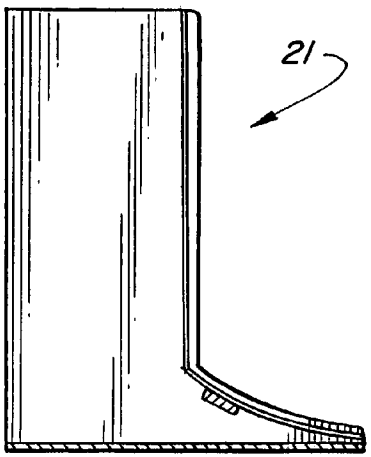
FIG. 9 is a side view of the second display module of FIG. 8.
Figure 8:
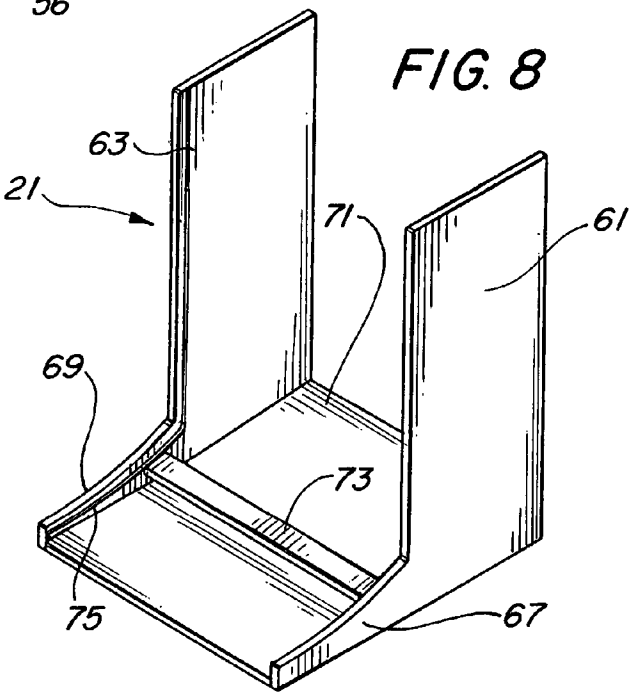
FIG. 8 is a perspective view of a second display module for use in the display apparatus of FIG. 1.

FIGS. 8 and 9 further illustrate the third display module 21, which mounts the video monitor 29 (FIG. 1). The module 21 includes first and second rectangular vertical side panels 61, 63 spaced apart by a width appropriate to mount the video monitor 29. The side panels 61, 63 further include horizontally extending display card mounting portions 67, 69 in which are formed suitably curved grooves 75 for receiving a display card as described in further detail hereafter. The module 21 further preferably includes a horizontally disposed rib 73, which provides a support structure to horizontally stabilize the module 21. Again, the module 21 may be fabricated of suitable wood or wood substitutes according to techniques well-known to those in the woodworking arts.

Figure 10:
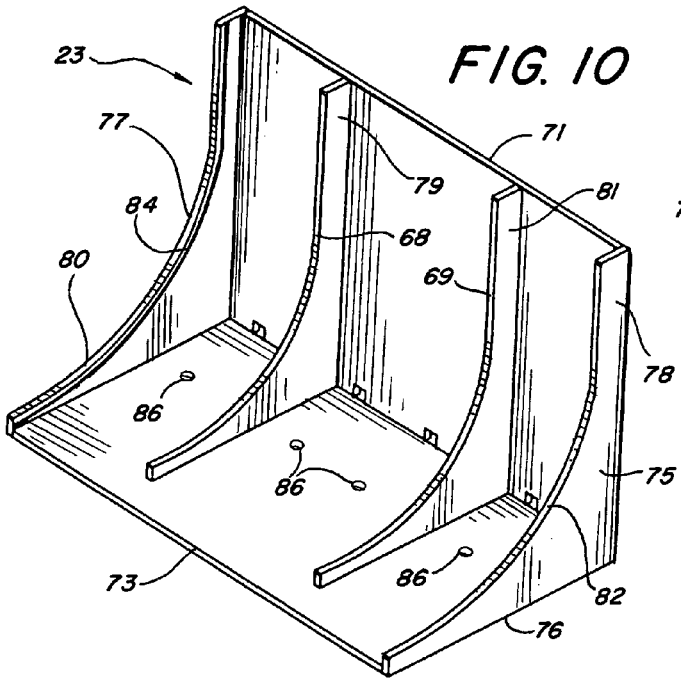
FIG. 10 is a perspective view of a third display module.
Figure 11:
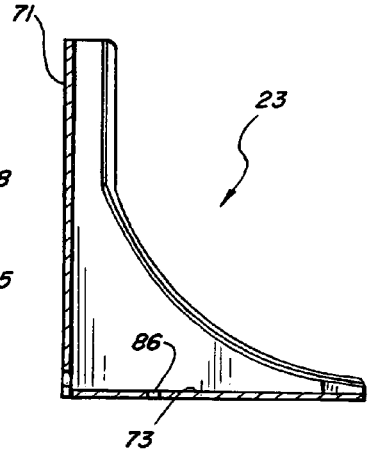
FIG. 11 is a side view of the display module of FIG. 10.

FIGS. 10 and 11 illustrate the fourth display module 23 in more detail. The fourth module 23 includes a rectangular base member 73, a vertical rectangular back panel 71 and respective vertical side panels 75, 77. The side panels 75, 77 each have a horizontal bottom edge 76 and a vertical back edge 78. Each of the display panels 75, 77 further has a concave outer edge 80, 82 and an interior concave groove, e.g., 84, for receiving the display panel 28. The respective interior grooves, e.g., 84, are mirror images of and lie parallel to one another.

The fourth display module 23 further includes first and second interior support panels 79, 81, each of which has a respective horizontal bottom edge, vertical back edge, and a concave surface 68, 69. The concave surfaces 68, 69 are parallel to one another and disposed in line with the grooves 84 so as to provide support to the display panel 28, after it has been inserted into the grooves 84, as described in more detail below. Finally, the bottom panel 73 of the module 23 includes a number of water drainage holes 86. These holes cooperate with the fire sprinkler water distribution system to be described in further detail below.

Figure 12:
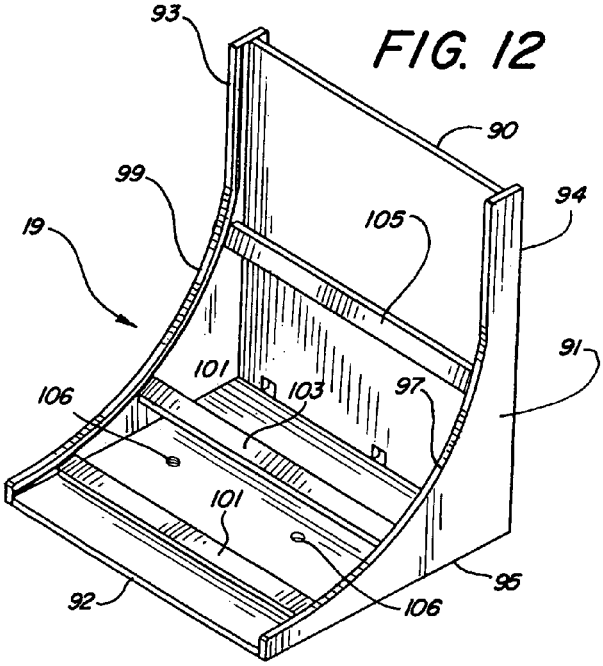
FIG. 12 is a perspective view of a fourth display module.
Figure 13:
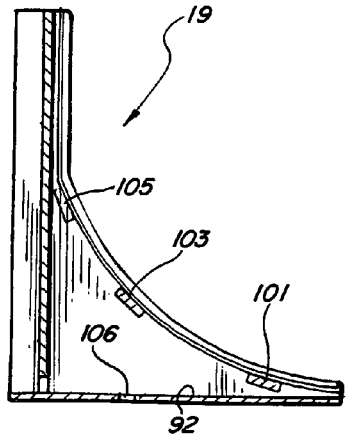
FIG. 13 is a side view of the display module of FIG. 12.

FIGS. 12 and 13 illustrate the second display card holding module 19 in more detail. The module 19 includes first and second vertically disposed side panels 91, 93, each of which has a vertical back edge 94 and a horizontal bottom edge 95. Each of the side panels 91, 93 further includes a concave outer edge 97, 99. Each interior side surface of each of the side panels 91, 93 includes a concave groove, e.g., 101. The grooves 101 are again mirror images of and disposed parallel to one another. The second display module 19 further includes a vertical rectangular back panel 90 and a horizontal rectangular base panel 92. Again, suitable drainage holes 106 are created in the bottom panel 92.

Figure 14:
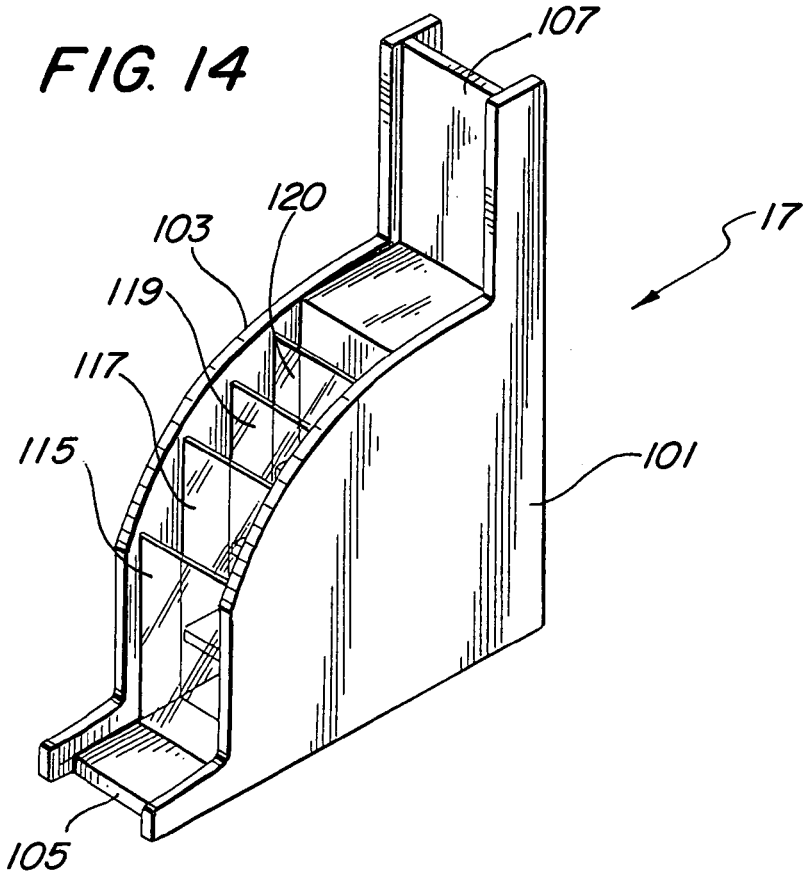
FIG. 14 is a perspective view of a fifth display module.
Figure 15:
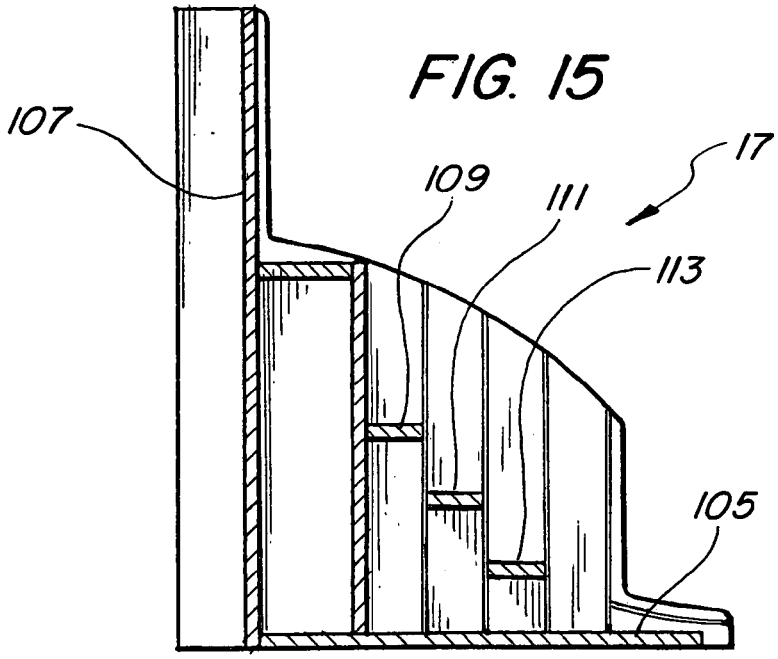
FIG. 15 is a side view of the display module of FIG. 14.

FIGS. 14 and 15 illustrate the first display module 17 in more detail. The first display module 17 includes first and second side panels 101, 103 contoured similarly to those of the display module 25 of FIGS. 3-5. Like module 25, the module 17 includes a horizontal rectangular base panel 105 and vertical rectangular back panel 107. The module 17 further includes a plurality of rectangular horizontal deck members 109, 111, 113, disposed in step-like fashion with respect to one another. The module 17 further includes a number of vertical transparent face plates 115, 117, 119, 120, which may be, for example, disposed in suitable grooves in the side panels 101, 103 and retained in place by a suitable adhesive. A hole 29 is formed in the base panel 105 through which a fastening device such as a screw may be inserted to attach the module 17 to an underlying shelf or other structure.

Figure 16:
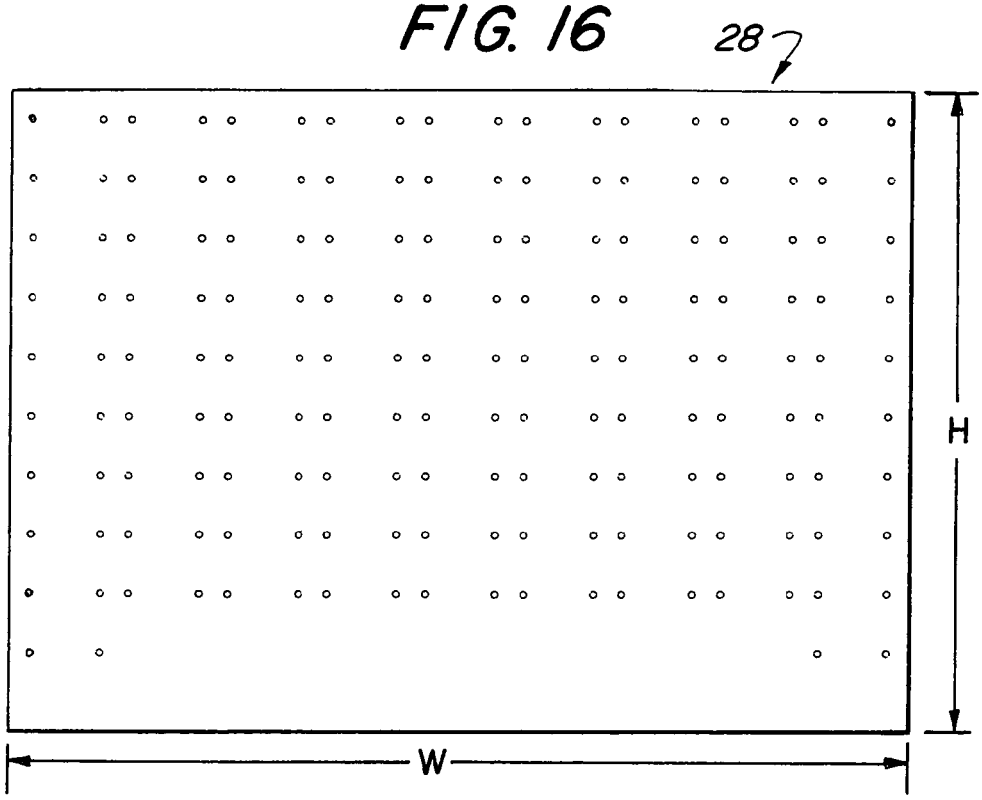
FIG. 16 is a front view of a display panel insertable into the fourth display module of FIG. 12.
Figure 17:
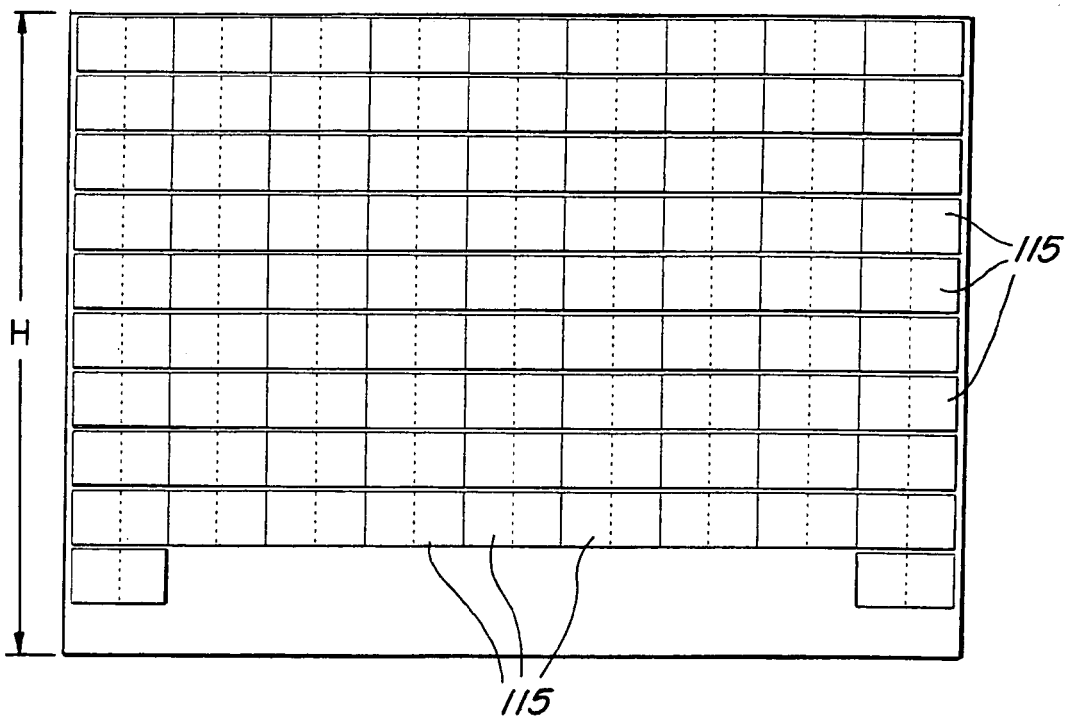
FIG. 17 is a front view of the display panel of FIG. 16 with a plurality of sample chip display units mounted thereon.
Figure 34:
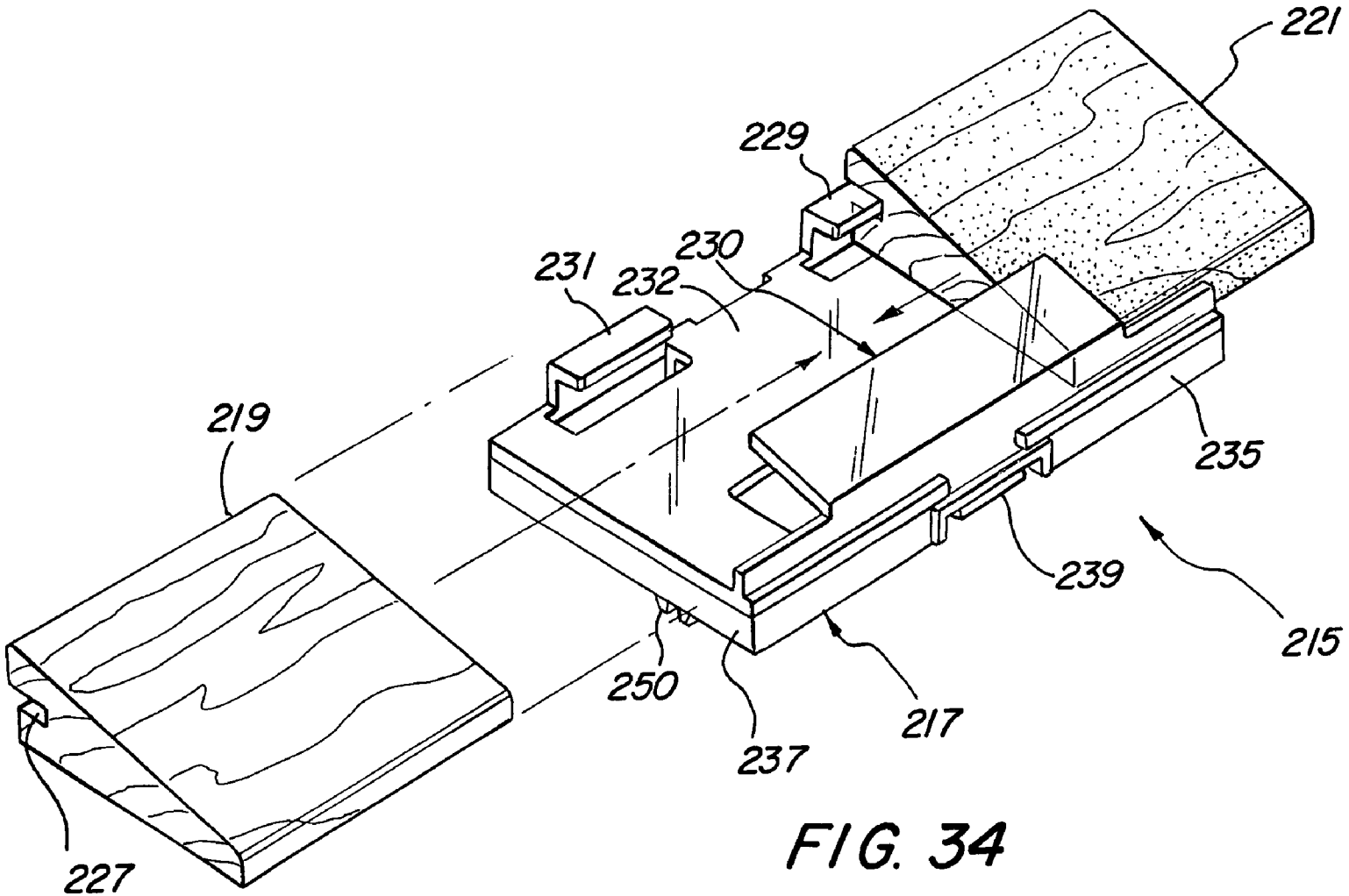
FIG. 34 is a perspective view of a removable chip holder component of the chip mounting mechanism.

FIGS. 16 and 17 show an illustrative embodiment for a display panel 28 (FIG. 1) for insertion into the fourth display module 23. The panel 28 shown in FIG. 15 may comprise, for example, a rectangular panel of 0.125 millimeter thick expanded PVC. Illustrative dimensions of such a panel are 825.5 millimeters (32.5 inches) in width (w) and 590.55 millimeters (23.250 inches) in height (h). As further illustrated, suitable holes 113, which may be for example 166 in number, are punched or otherwise created in the panel 28 in order to attach sample mounting chips such as are illustrated in FIG. 34. FIG. 17 illustrates the graphic layout of sample chips 115 on the panel 28. During installation, the flat panel 15 is inserted into the curved slots in the module and thereby is effectively turned into a curved panel, which is more suitable to a typical consumer's line of sight and results in improved light distribution and space conservation.

Figure 18:
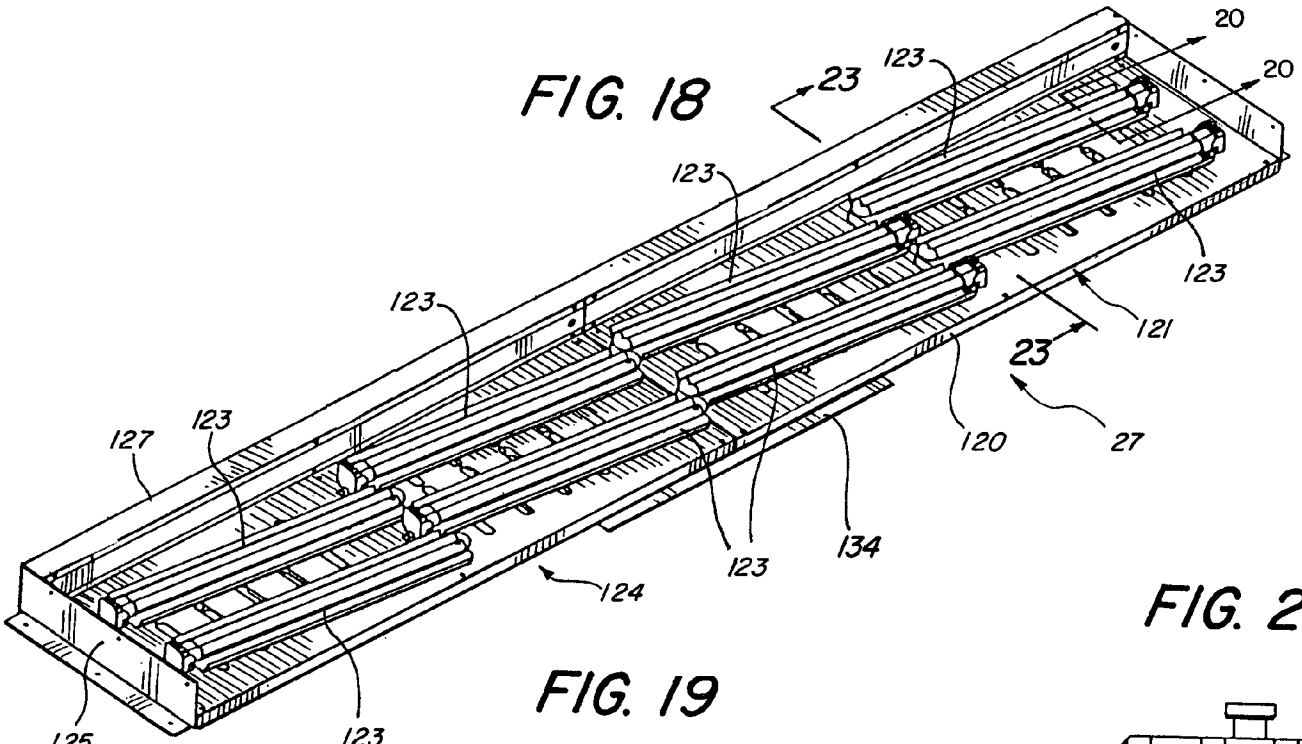
FIG. 18 is a perspective view of a recessed lighting fixture of the display apparatus of FIG. 1.
Figure 19:
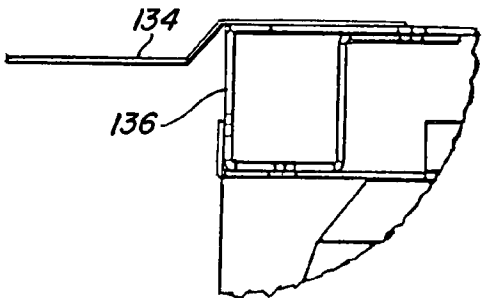
FIG. 19 is a sectional view of the apparatus taken at 19-19 of FIG. 23.
Figure 21:
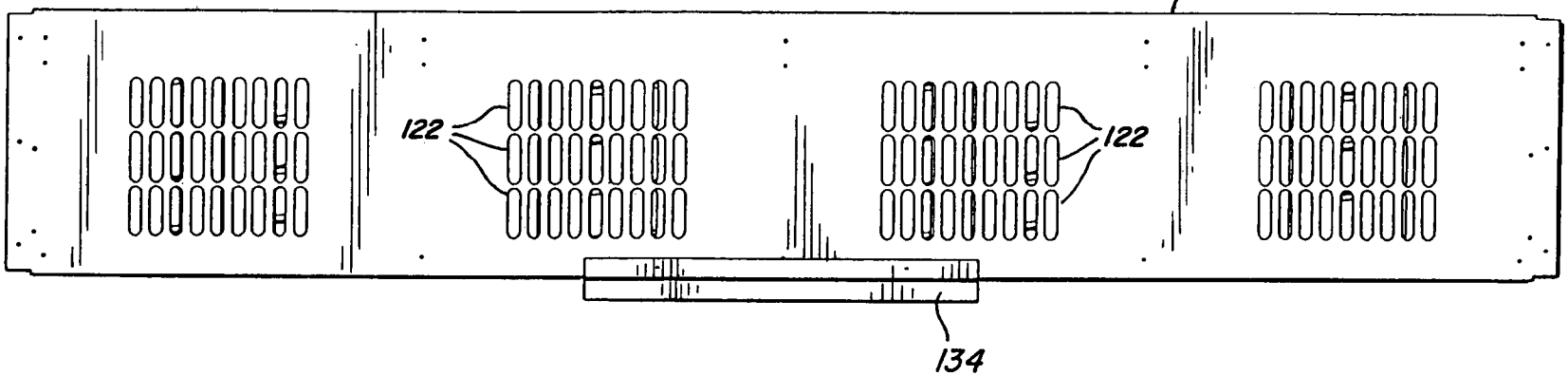
FIG. 21 is a top view of the lighting fixture of FIG. 18.
Figure 22:
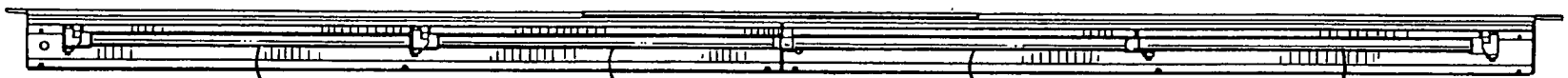
FIG. 22 is a side view of the fixture of FIG. 18.

FIGS. 18 thru 23 illustrate the recessed lighting fixture or "light box" 27 of FIG. 1 in more detail. The fixture 27 includes a number of pairs of fluorescent lamp fixtures 123 disposed within a housing 124. Each lamp fixture 123 preferably includes a biaxial lamp unit, preferably a Philips PL-L55W, 55 watt, 5500 K, 92 CRI unit. A CRI of 90 or above is preferred. The housing 124 comprises a perforated horizontal mounting (ceiling) panel 121, first and second rectangular vertical end members 125, 126 and a rear edge member 127. FIG. 19 illustrates a centered header attachment support 134, and a rectangular reinforcement member 136, which member 136 preferably extends the entire length of the light box 127. The header support 134 and reinforcement member 136 serve to prevent sagging of the middle of the structure. The member 136 may, for example, be a metal tube or formed from a portion of a metal sheet used to fabricate panel 121.

Each fixture of the pair of lighting fixtures 123 is mounted parallel to an adjacent fixture 123 and at a slight acute angle to the horizontal edge 130 of the mounting panel 121. The acute angle may be for example eight (8) degrees. The light fixtures 123 are so arrayed as to create a uniform lighting effect on the concave display panels. As may be seen in FIG. 22, the pairs of parallel light tubes of the fixtures 123 lie horizontally and provide a substantially linear line of light-radiating surface.

Figure 20:
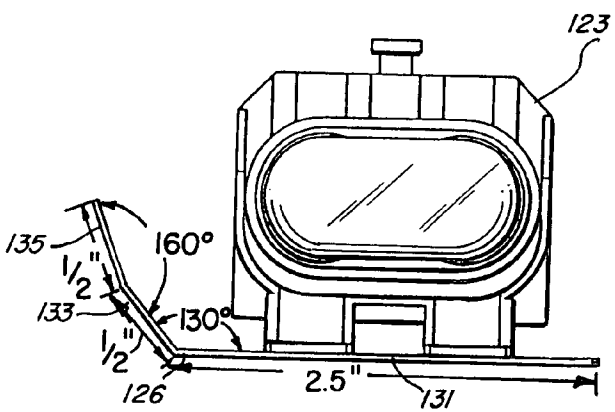
FIG. 20 is an end view of a lamp fixture utilized in the apparatus of FIG. 18.

FIG. 20 shows a detail of a lamp fixture 123 and its associated reflector 131. A single side reflector 131 is positioned behind each lamp fixture 123. The reflector 131 is especially designed with angled side sections 131, 135 in order to appropriately direct the light. Angled section 133 may be ½" in length and formed at an angle of 130 degrees with respect to horizontal portion 126, which may be 2.5 inches in width. Angled portion 135 may also be ½" in length and formed at an angle of 160 degrees to angled portion 135. The reflecting surface may be 95% reflective, 92% specular. The single side reflector 131 further directs light downwardly, preventing glare in the customer's eyes.

Figure 23:
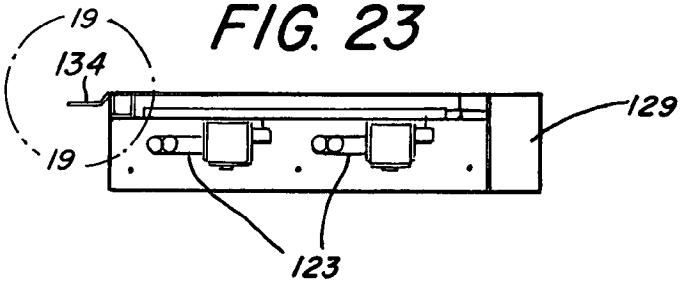
FIG. 23 is a sectional view of the fixture of FIG. 18 taken at 23-23.
Figure 23A:
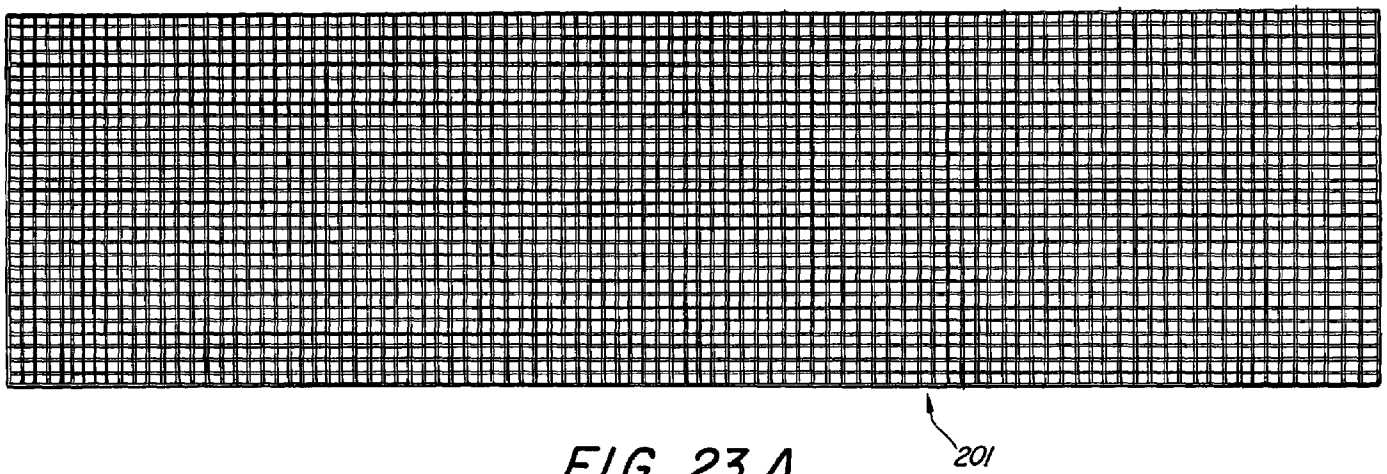
FIG. 23*a* is a top view of a diffuser component employed in connection with the light fixture of FIG. 18.
Figure 23B:
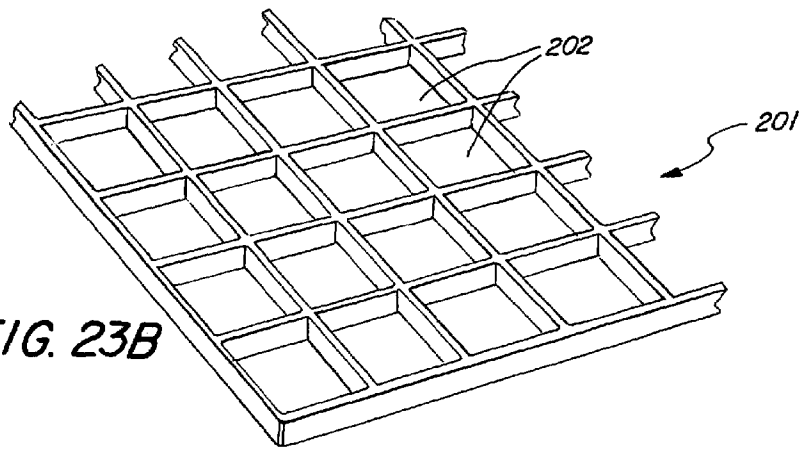
FIG. 23*b* is an enlarged view of a fragment of the diffuser of FIG. 23*a;*

FIG. 23 illustrates a decorative front face plate 129 which closes the front of the fixture 27 and is seen by one viewing the display 11. A diffuser grill 201 (FIG. 1) is mounted at the bottom of the lamp fixture 27 and is further illustrated in FIGS. 23A and 23B. The diffuser may be a rectangular plastic grill ("egg crate" diffuser) comprising square openings each of which may be ½ inch on a side.

The lamp mounting arrangement shown in FIG. 18 positions a light producing lamp portion adjacent to a "tombstone" lamp mounting receptacle. The light box 27 is relatively shallow in depth and the staggered arrangement of light fixtures 123 together with the diffuser 201 substantially eliminates dark spots and provides a uniform, customer-attracting and aesthetically pleasing light distribution.

Figure 25:
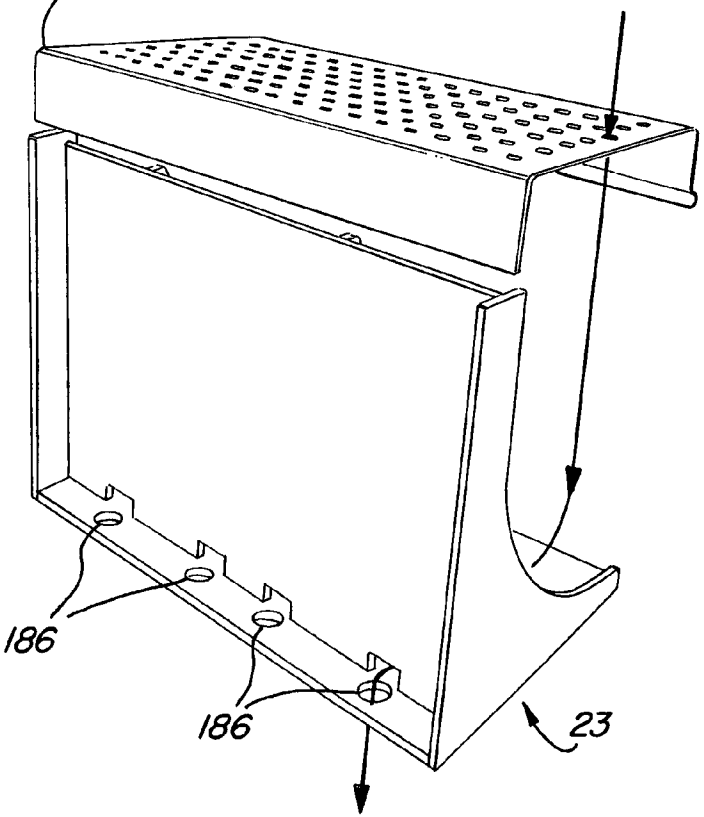
FIG. 25 is a rear perspective view of the apparatus of FIG. 24.
Figure 24:
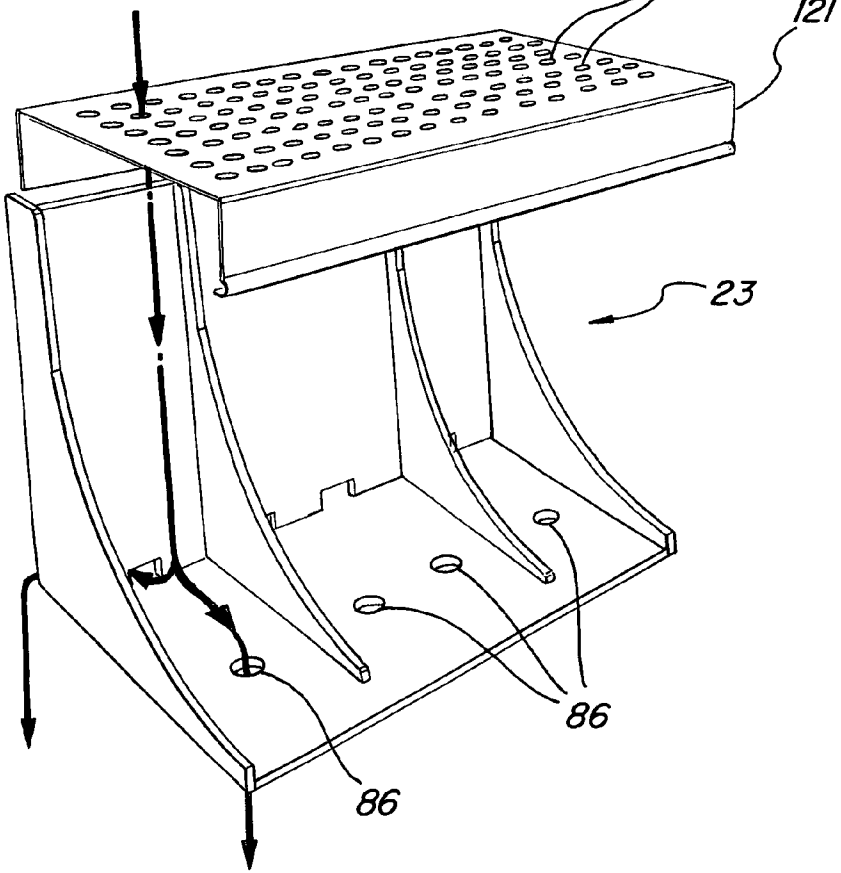
FIG. 24 is a perspective view of components of the display apparatus of FIG. 1 illustrating a water flow through feature.

FIGS. 24 and 25 illustrate an advantageous irrigation feature, which cooperates with sprinkler systems positioned above the display 11 to distribute the flow of fire retarding water throughout the unit and to goods e.g. 202 (FIG. 1), stored beneath the display 11. As may be seen, the perforations, e.g., 122, in the light fixture housing 121 cooperate with holes, e.g., 86, 186, in underlying module members to permit water flow down and throughout the display 11 and its modular components 17, 19, 21, 23, 25. Holes 186 and 86 overlie matching holes e.g., 57 in the cabinet 13.

Figure 27:
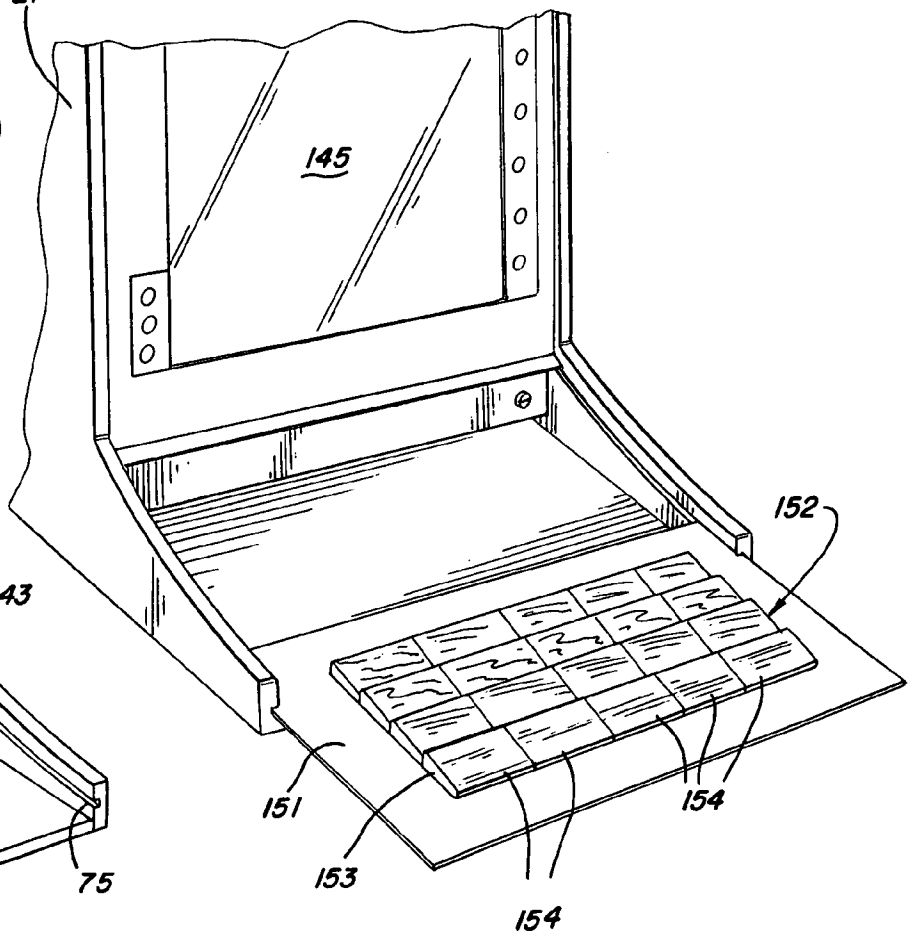
FIG. 27 is a perspective view of a portion of the interactive video apparatus of FIG. 26 further illustrating a removable paint chip display panel.
Figure 26:
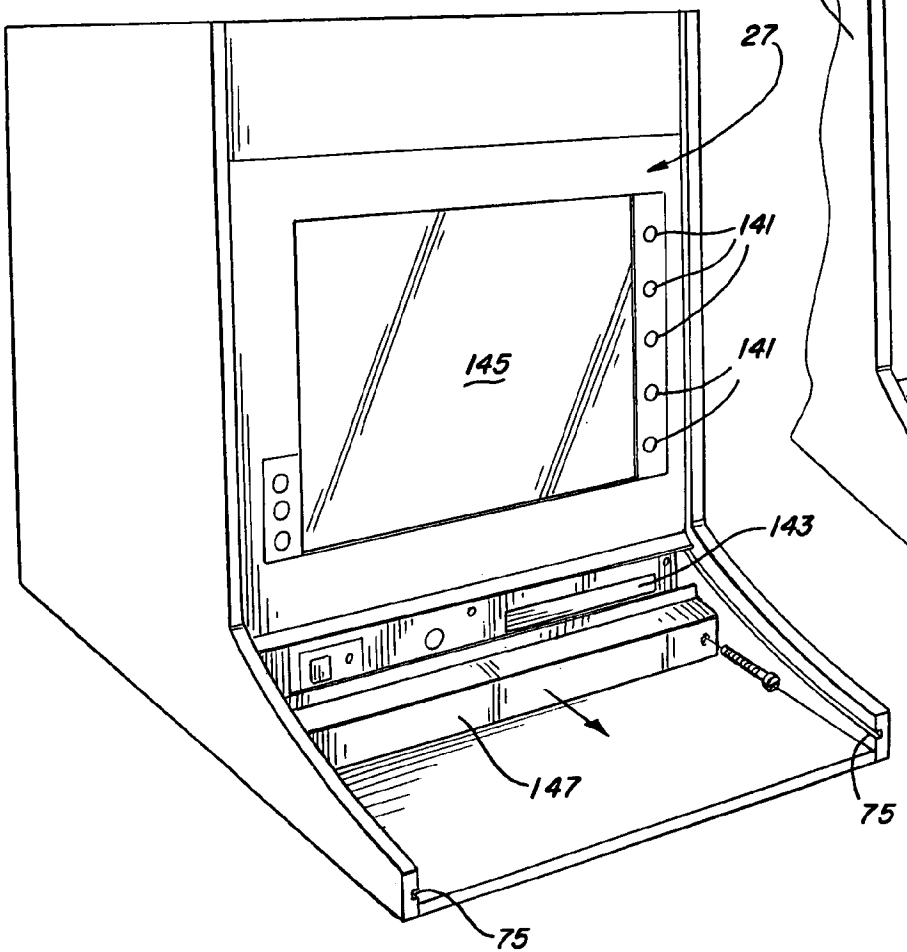
FIG. 26 is a perspective view of an interactive video module of the apparatus of FIG. 1.
Figure 28:
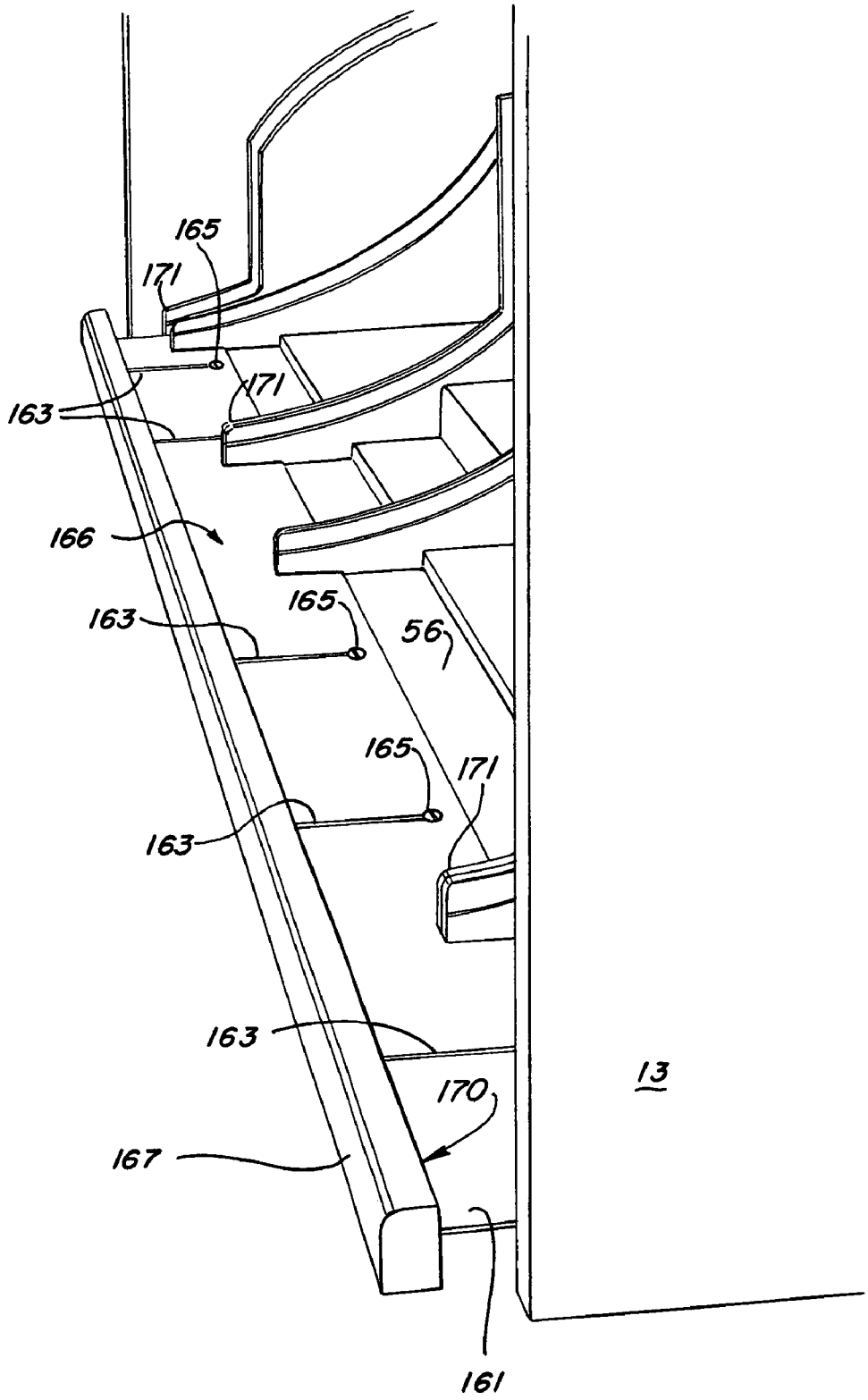
FIG. 28 is a perspective view illustrating an apparatus for securing the display modules of the display apparatus of FIG. 1 in position.

FIGS. 26 and 27 illustrate further details of the interactive video module 21. The module 21 encloses a video display monitor 29 which has a display viewing screen 145 and user manipulated buttons 141. The buttons 141 permit a user to step through a menu of audio/video displays describing, for example, various tasks required in applying and selecting stains, waterproofing, and other products.

FIG. 26 shows a cover plate 147 in a removed position, revealing a DVD/DVI player 143. The DVD or DVI player 143 may be an adaptation of a commercially available unit providing a track selection feature cooperating with the buttons 141. FIG. 27 further illustrates a display panel 151 partially inserted into the concave grooves 75 of the module 21. The display panel 151 may carry, for example, four rows of wood chips, e.g., 152, 151 selectively stained. Each of the chips 154 may comprise a different species of wood each stained with the same stain, thereby illustrating to the consumer the different effects which the underlying wood can have on the finished appearance of the stained wood.

FIGS. 28 thru 31 illustrate an apparatus and method for securing the modules 17, 19, 21, 23 into the surrounding cabinet 13. In particular, a flat horizontal panel 166, preferably sheet metal, is provided with suitable parallel slots 163 and with a front molding piece 167 providing a vertically extending surface 170 for abutting respective noses 171 of the modules 17, 19, 21, 23, 25. A stud 165 is positioned in each slot 163 and serves to position and guide the panel 166. The panel 166 is slideable in and out between the shelf 56 and the base panels 47, 71, 92, 73, 105 of the respective modules 17, 19, 21, 23, 25, guided by the studs 165.

Figure 30:
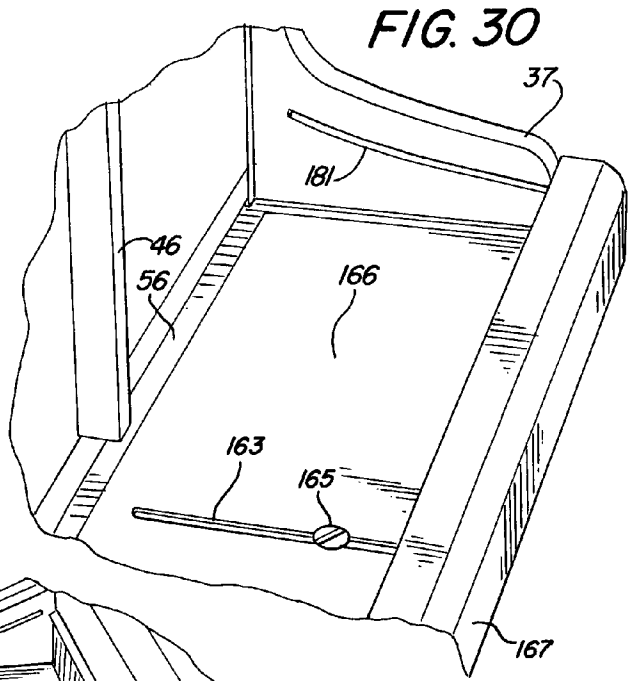
FIG. 30 is a perspective of a portion of the apparatus of FIG. 28 illustrating the installed position.
Figure 31:
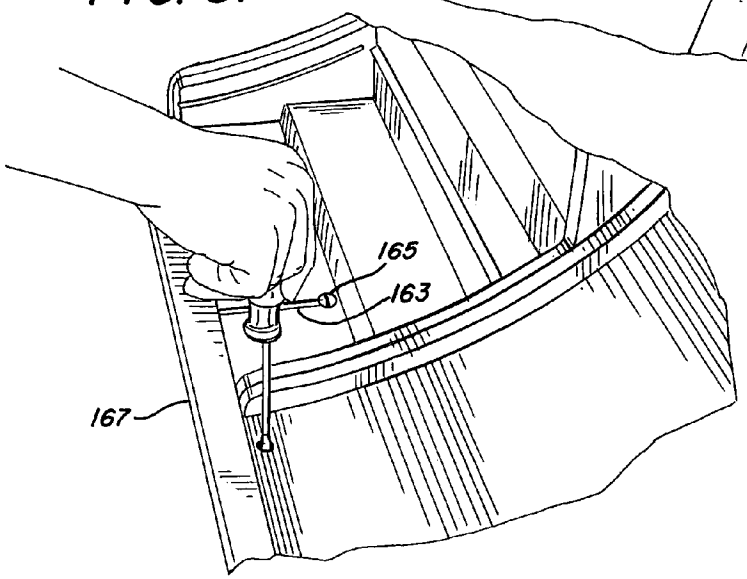
FIG. 31 is a fragmentary view further illustrating an alternate method and an apparatus for securing display modules of the display apparatus in position.
Figure 29:
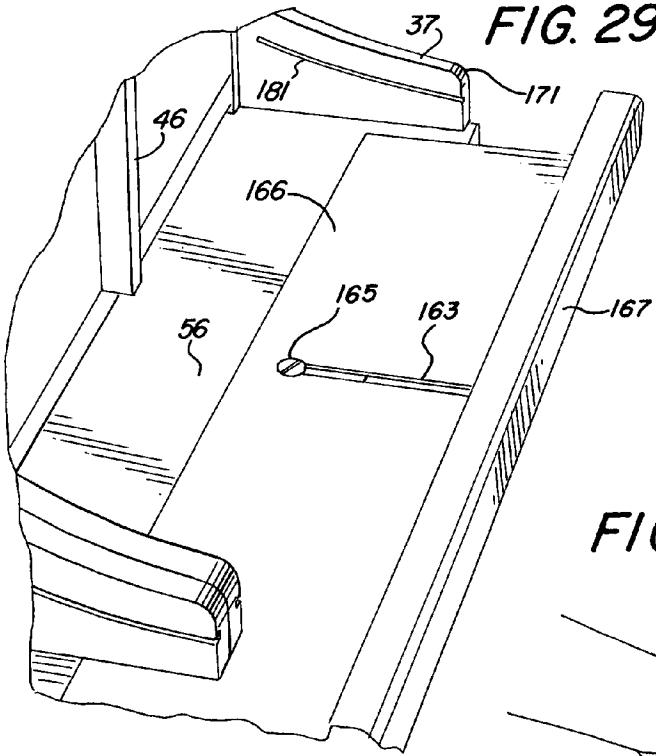
FIG. 29 is a enlarged perspective view of a portion of the apparatus of FIG. 28.
Figure 32:
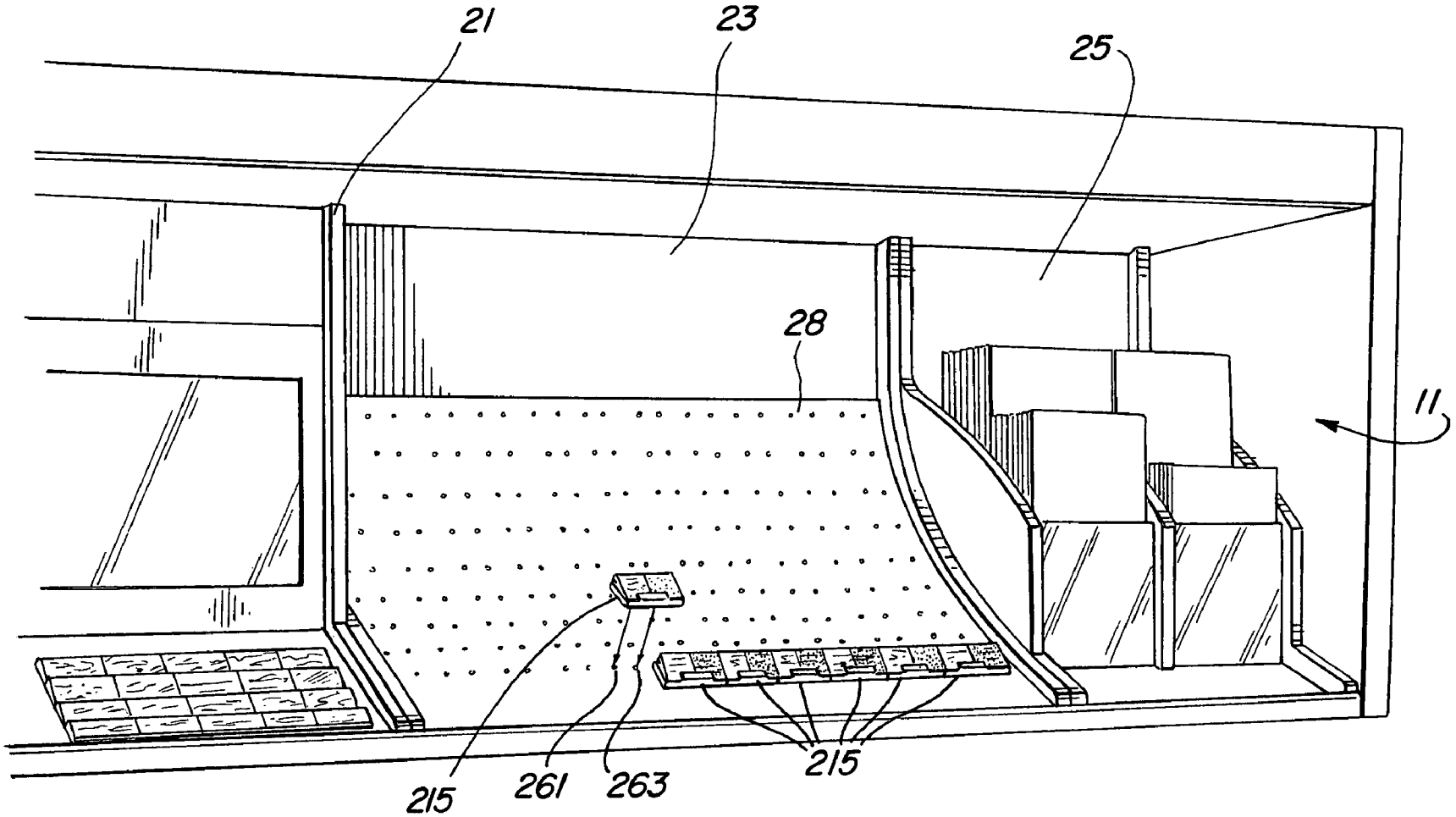
FIG. 32 is a fragmentary view of a portion of the display panel of the display 11 of FIG. 1 illustrating a particular embodiment of a wood chip mounting mechanism.

Considering FIGS. 29 and 30, in the order to secure the modules 17, 19, 21, 23 in place, the front molding piece 167 is pushed in towards the respective noses 171 of the modules 17, 19, 21, 23, 25 until the position shown in FIG. 30 is reached, at which point, screws or other devices are inserted through the holes 26, 29 in the base of each of modules 17, 25, then through the sheet metal panel 166, and finally into the shelf 56, thereby securely fixing the molding piece 167 and hence the modules 17, 19, 21, 23, 25 in position. Other means of securing the modules in place can of course be used. In one alternate embodiment, for example, a piano hinge could be used to mount a suitable front molding piece 167. It will also be noted further that the placement of the fastening devices through holes 26, 29 in the respective brochure modules 17, 25 renders them inconspicuous, for example, as compared to side insertion through panel 13. FIG. 31 illustrates an alternate approach wherein a screw or other fastening device is inserted through a display panel, then through a module base and a sheet metal panel, and into the shelf 56. The approach using holes 26, 29 is preferred over this approach because it is less conspicuous.

Figure 33:
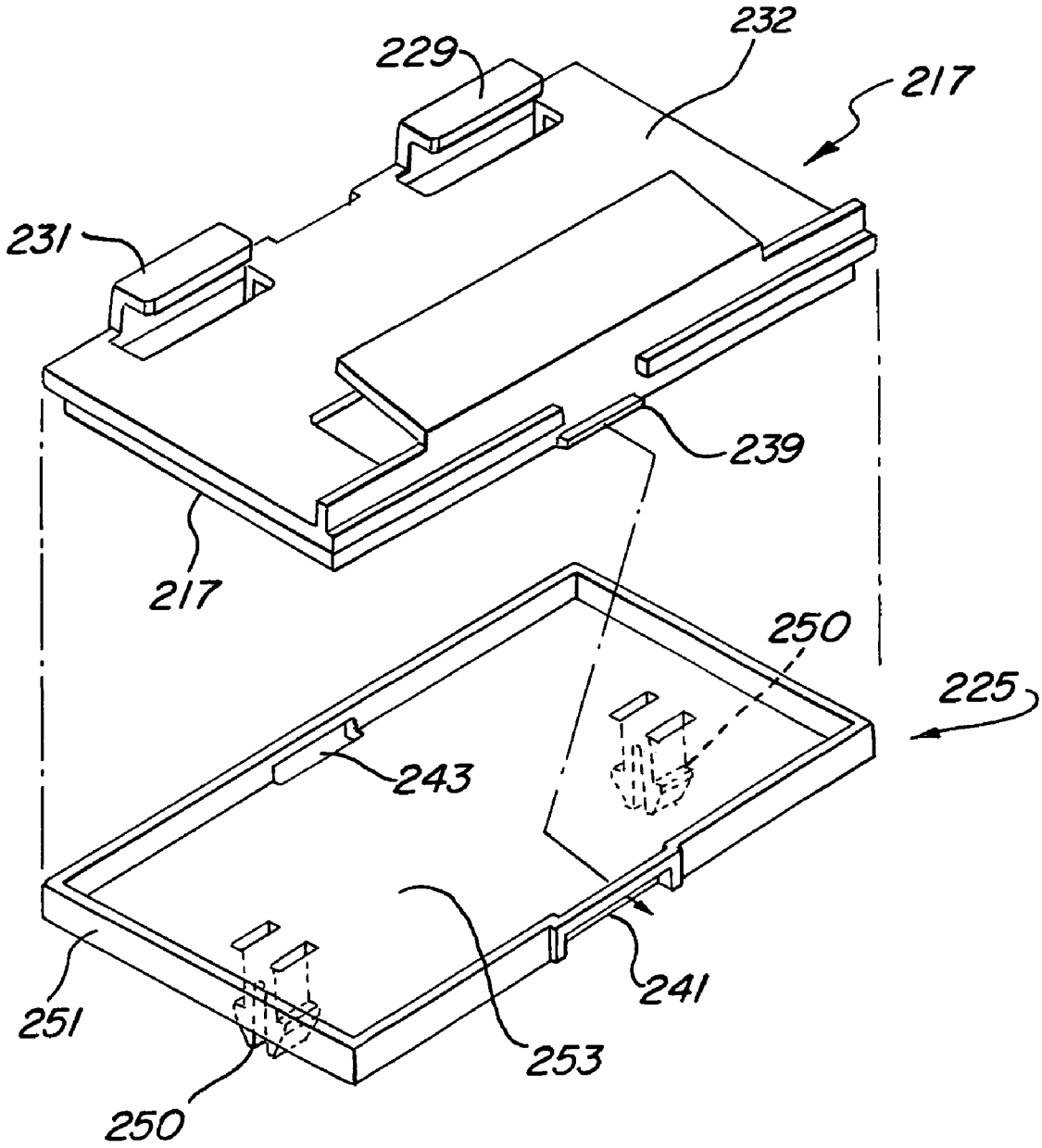
FIG. 33 is a perspective view of a chip clip mounting mechanism in disassembled relation.

FIGS. 32 through 37 illustrate a chip mounting mechanism 215. As illustrated in FIG. 33, the chip mounting mechanism includes a removable chip holder 217, which mounts into a carrier 225. Both the chip holder 217 and the carrier 225 may be fabricated, for example, of a suitable molded plastic.

Figure 35:
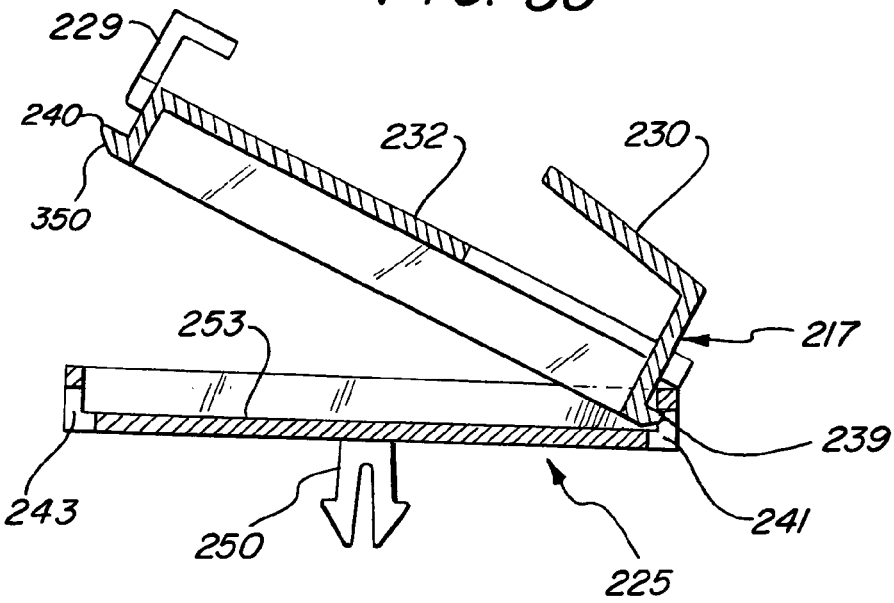
FIG. 35 through 37 are sectional views illustrating the sequential assembly and installation of a chip mounting mechanism.

The chip holder 217 includes a base portion 232 on which is formed first and second horizontal tabs 229, 221 and an acutely angled tab 230. The chip holder 217 further includes vertically depending edge portions 235, 237 and respective lips 239, 240 (FIG. 35). Each lip 239, 240 has a cammed surface 350 to facilitate installation as further described below.

As illustrated in FIG. 34, the tabs 229, 231, 230 facilitate removable mounting of respective wood chips 219, 221, each of which has a groove 227 formed therein for slideably receiving the respective tabs 229, 231. The opposite ends of the respective chips 219, 221 slide snuggly underneath the acutely angled tab 230.

The carrier member 225 includes a flat rectangular bottom 253 and a generally rectangular rim 251 formed about the periphery of the bottom 253. First and second slots 241, 243 are formed in the carrier member 225 for receiving the respective tabs 239, 240 (FIG. 35) of the chip holder 217. The vertically depending edge portions 235, 237 of the chip holder 217 are sized such that they snuggly fit within the rectangular rim 251 of the carrier member 225. On the underside of the bottom 253 of the carrier member 225 are formed respective expandable plugs 250, which insert into respective adjacent mounting holes e.g., 261, 263 formed in the display panel 28.

Figure 36:
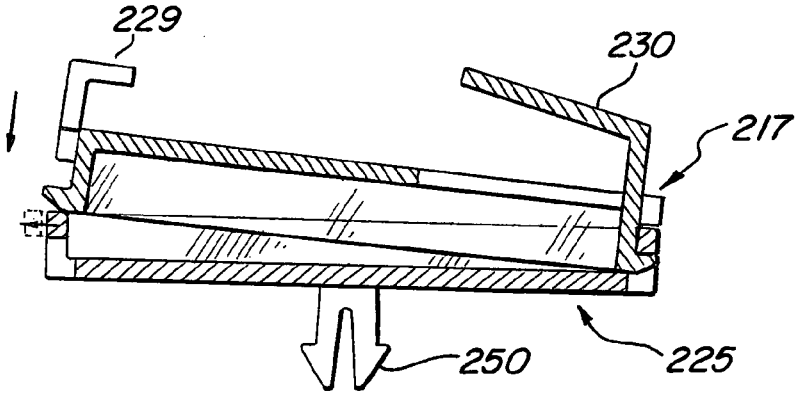
Figure 37:
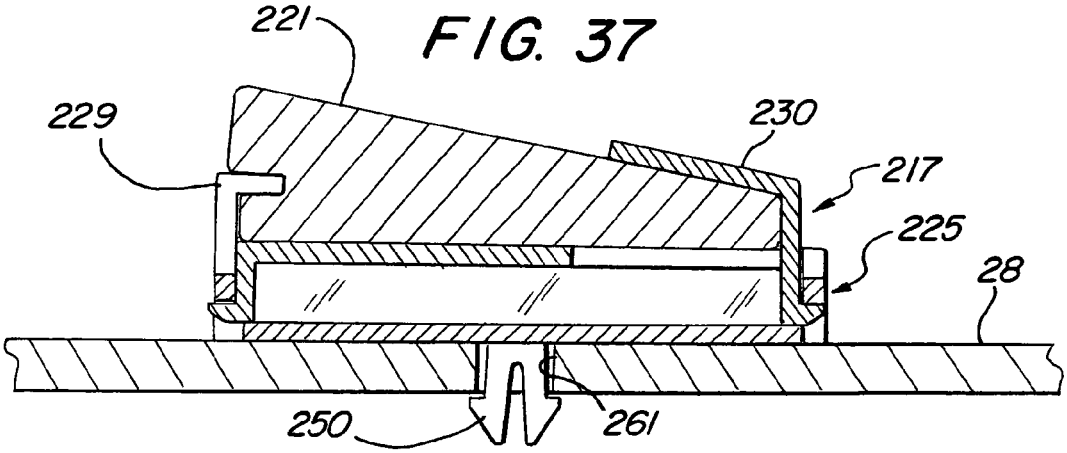

FIGS. 35 through 37 illustrate the manner of insertion of the removable chip holder 217 into the carrier member 225. As shown, the first lip 239 is engaged with the first slot 241, and then the chip holder 217 is pressed downward such that the second lip 240 snaps into the slot 243 with the assistance of the cammed surface 350, thereby snuggly joining the chip holder 217 and carrier member 225 together. Suitable wood chips, e.g., 229 may then be slideably inserted into the chip carrier 217. Thereafter, the assembled unit may be mounted on the display panel 28 by inserting the prongs 250 through the respective mounting holes, e.g., 261, resulting in the mounted position shown in FIG. 37. The construction illustrated in FIGS. 32-37 permits sample chips to be removed by the retailer (but not the customer) for purposes of changing out or updating different chips, as desired.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A display apparatus comprising:

a shelf;

a plurality of separate display modules, each adapted to display one of a plurality of items, each item being different from that displayed by any other of said plurality of modules;

wherein a first of said modules comprises:

first and second juxtaposed side panels, each having an inwardly facing groove formed therein, each groove having a curved contour; and a flexible display panel, said panel lying flat in an unassembled state and being insertable into said respective grooves whereupon said panel assumes the curved contour defined by said respective grooves;

wherein a second of said modules comprises:

first and second side panels each of which has a bottom edge and a back edge, the back edge and bottom edge meeting at right angles to one another;

a front edge of each of said side panels being defined by a first vertical linear section, which meets with a convexly curved section, which then leads to a second vertical depending section;

said side panels being connected to a back panel, a floor panel, and an upper horizontal panel;

at least one horizontal deck panel located between said side panels;

at least one clear vertical face panel located between said side panels; and wherein a third of said display modules comprises:

first and second vertical side panels spaced apart by a width selected to permit mounting of a video monitor;

the side panels further including horizontally extending display card mounting portions in which are formed grooves for receiving a display card; and an interactive video monitor mounted between said first and second side panels.

2. The apparatus of claim 1 wherein said interactive video module comprises user selectable audio/visual segments.

3. The apparatus of claim 1 wherein said first module comprises a module for displaying wood chips and wherein said second module comprises a module for displaying brochures.

4. The apparatus of claim 1 further including a flat panel slideable into position beneath respective flat bottom panels of each of said first, second and third modules, said flat panel having a lip for abutting each of said plurality of modules, said flat panel being fastenable in an installed position to retain said modules in place on said shelf.

5. The apparatus of claim 4 further including a plurality of slots in said flat panel cooperating with a plurality of guide studs for controlling the position of and guiding movement of said flat panel.

6. The apparatus of claim 1 further comprising means for retaining each of said first, second and third modules in position on said shelf.

7. The apparatus of claim 1 wherein said curved contour is convex.

8. The apparatus of claim 1 wherein said flexible display panel mounts a first plurality of wood chips, each having a selected waterproofing coating applied thereto and wherein a second panel of a fourth of said plurality of display modules mounts a second plurality of wood chips each stained with a selected wood stain.

9. The apparatus of claim 1 wherein said second module further includes:

a central panel;

first and second respective deck panels, the first deck panel being disposed between the first side panel and the central panel and the second deck panel being disposed between the central panel and the second side panel, respectively;

first and second clear vertical face panels mounted in respective slots in the respective side and central panels.

10. The apparatus of claim 9 wherein the face panels comprise plexi-glass anchored in place by a suitable adhesive.

11. The apparatus of claim 10 wherein the panels of each of said first, second and third modules are fabricated of suitable wood or wood substitute materials.

12. The apparatus of claim 1 wherein said shelf comprises a portion of a cabinet having first and second rectangular vertically disposed end panels.

13. The apparatus of claim 1 wherein said interactive video monitor comprises a display viewing screen and user manipulated buttons, the buttons facilitating user step-through of a menu of an audio/video display.

14. The apparatus of claim 1 wherein said third module further presents four rows of wood chips selectively stained.

15. The apparatus of claim 14 wherein each of the chips comprises a different species of wood each stained with the same stain, thereby illustrating to the consumer the different effects which the underlying wood has on the finished appearance of the stained wood.

* * * * *